US005560743A

United States Patent [19]

Imayama et al.

[11] Patent Number: 5,560,743

[45] Date of Patent: Oct. 1, 1996

[54] METHOD OF FINE GRAIN MILLING AND MACHINE THEREFOR

[75] Inventors: Hirotaka Imayama, Kawasaki; Katsuya Fukasawa, Yokohama; Masayasu Fujisawa, Naka-gun; Yoshiki Hagiwara, Hadano, all of Japan

[73] Assignee: Hitachi, Ltd., Tokyo, Japan

[21] Appl. No.: 26,770

[22] Filed: Mar. 5, 1993

[30] Foreign Application Priority Data

Mar. 5, 1992 [JP] Japan ..... 4-048229

[51] Int. Cl.[6] ..... B24C 3/04

[52] U.S. Cl. ..... 451/2; 451/82; 451/89; 451/78

[58] Field of Search ..... 51/319, 311, 310, 51/415, 419, 421, 416, 424, 425; 451/38, 29, 2, 82, 89, 78, 88, 87, 3, 30, 84

[56] References Cited

U.S. PATENT DOCUMENTS

| | | | |
|---|---|---|---|
| 919,417 | 4/1909 | Carroll | 51/419 |
| 1,679,369 | 8/1928 | Motz | 51/419 |
| 1,875,994 | 9/1932 | Davis | 51/419 |
| 2,272,686 | 2/1942 | McGibbon | 51/419 |
| 2,967,347 | 1/1961 | Rhea | 51/419 |
| 3,270,464 | 9/1966 | Bowling, Jr. | 51/426 |
| 3,869,830 | 3/1975 | Baker | 51/416 |
| 4,896,464 | 1/1990 | Kim et al. | 51/421 |

FOREIGN PATENT DOCUMENTS

| | | | |
|---|---|---|---|
| 0260392 | 9/1988 | Germany | 51/426 |

*Primary Examiner*—Robert A. Rose
*Attorney, Agent, or Firm*—Antonelli, Terry, Stout & Kraus

[57] ABSTRACT

A fine grain milling method which mixes powder into a high-pressure fluid, and injects the mixture to a workpiece covered with a mask or pattern to process the workpiece to a desired shape. Another high-pressure fluid is injected to remove the powder adhering to the workpiece thereby enabling an accurate transfer of the mask or pattern to the workpiece.

6 Claims, 15 Drawing Sheets t : TIME FOR NECESSARY TO OBTAIN PREDETERMINED DEPTH OF REMOVAL h : PREDETERMINED DEPTH OF REMOVAL

METHOD OF FINE GRAIN MILLING AND MACHINE THEREFOR

BACKGROUND OF THE INVENTION

The present invention relates to a fine grain milling method and machine and, more particularly to an air blasting method and machine, wherein the fine grain milling method and machine include a cleaning gas jet nozzle and a powder jet nozzle accurately transferring patterns of a mask covering predetermined surfaces of workpieces tie enable precise milling of the workpieces. As an example, the present invention deals with a process for processing an air bearing surface of a thin film magnetic head needed to be milled at a high accuracy.

In for example, Japanese Patent Application Laid-Open No. 63-22272 loose grains are mixed into a gas to make a gas-solid two-phase flow, with a nozzle being provided to inject the gas-solid two-phase flow to workpieces. A suction nozzle is provided for suctioning a mixture of chips and blasting materials.

In order to form concavities of predetermined dimensions on the work materials using the fine grain milling process, as shown in FIG. 2A, a mask is used to cover portions other than the concavities on surfaces of the workpieces before the workpieces are milled. A pattern of the mask, then, is transferred to the workpieces. If a powder jet nozzle injects the powder to mill the workpieces, the injected powder is likely to accumulate at edges of the mask. The accumulated powder covers over portions other than the mask on the surfaces of the workpieces, thereby resulting in the surfaces being masked on a wider area than the original mask. This result is disadvantageous in that that the fine grain milling process cannot accurately transfer the mask pattern to the concavities formed on the workpieces. FIGS. 2A, 2B, and 2C illustrate such an adverse blasting process. If the mask is a band of equal width, for example, an apparent width tends to become wider during blasting. The boundary between a concave and convex cannot be formed so as to be vertically perpendicular to the concavity, but assumes an unfavorable gentle slope. The mask likely accumulates the grains, particularly in corners thereof as shown in FIG. 2B. Namely, the corners formed by the mask edge and the surface of the work material are round shaped due to the accumulated grains, causing the milled corners to be round shaped, as shown in FIG. 2C.

If the grains are injected with the workpieces stationarily positioned relative to the powder jet nozzle, a uniform of the grains removal cannot be achieved. Inner work materials are blasted deep, and outer workpieces are made shallow. For the reason, the depth of removal cannot be made uniform only by moving the workpieces materials in one direction relative to the nozzle. In addition, if the workpieces are arranged on a circumference of a circular workpiece holder, which is revolved around its center, as shown in FIG. 1, the depth of removal is less with the outer circumference, and more with the inner circumference because of the difference between the outer and inner circumference distances. This is due to equal volume of removal per unit of time.

With such problems in the prior fine grain milling process as pointed out above, it has the disadvantage that it is not possible to fabricate precision devices, such as a thin film magnetic head which meets required specifications. The impossibility will be explained below by reference to FIGS. 3A and 3B. In the usual magnetic disk drive, the magnetic head is constructed so as not to levitate higher than 1 μm by an air flow above the revolving magnetic disk. The magnetic disk drive may have an increased recording density with the dispersion of magnetic flux given by the magnetic head being reduced on the magnetic disk. The magnetic flux of the magnetic head is generated from a gap of an electromagnetic transducing element in the magnetic head. The magnetic flux density at a point is high with the point being close to the gap. The magnetic flux also is reduced with the point close to the gap. That is, the recording density can be increased as a distance, that is levitation, between the magnetic disk and the gap of the magnetic head is reduced and as the magnetic flux is narrowed. In order to minimize and stabilize the levitation of the magnetic head, is necessary to make a machine mill wherein a shape of an air bearing surface of the magnetic is as accurate as possible. In forming the air bearing surface of the magnetic head as shown in FIGS. 3A and 3B, it is easy to mill such a linear shape as in FIG. 3A, using a grinder or similar means in mass production. Even if an attempt is made to obtain a shape of varying width as in FIG. 3B with the grinder, however, the shape has some portions remained not milled. This is due to the fact that the revolving grinder cannot form the complicated shape but only a linear shape.

The prior art fine grain milling machine includes rubbing parts in a milling chamber in connection with movement of the workpieces and nozzle during blasting. If the grains flutter in the milling chamber, therefore, they are harmfully brought into the rubbing parts thereby damaging the rubbing parts with the result being that the rubbing parts have a reduced accuracy and shortened service life.

SUMMARY OF THE INVENTION

In view of the foregoing, it is an object of the present invention to provide a fine grain milling method and machine that can accurately transfer a complicated mask shape at workpieces to the workpieces a provide a uniform and depth.

Another object of the present invention is to provide a fine grain milling method and machine that can prevent grains and chips from being brought into rubbing parts in a milling chamber and the grains and chips to make move smoothly at a high operational accuracy for increasing the service life of the fine grain milling machine.

Briefly, the foregoing objects are accomplished in accordance with the present invention by providing a fine grain milling method and machine, wherein in the fine grain milling machine in which workpieces are formed to desired shapes, a powder mixed in a high-pressure fluid is injected to the workpieces covered with a desired mask of pattern. The machine include a workpiece holder for mounting the workpieces and the workpiece holder is rotatable around a main spindle. An injecting device, having a nozzle for injecting the powder mixed in the: high-pressure fluid to surfaces of the workpieces so that the surfaces of the workpieces can be formed to the desired shapes, has a removing device for removing adhered powder out of surfaces of the workpieces by injecting a high-pressure fluid to the powder adhering to the surfaces of the workpieces. A sealing box seals the workpieces holder and the injecting device so that the powder and chips of the workpieces cannot be leaked out, and a dust collecting device collects the powder and the chips out of the sealing box.

According to another embodiment of present invention, a relative motion of the workpiece holder and the nozzle is controlled so that the quantity and the speed of flow of the powder contacting a unit area of the surfaces of the workpieces in a unit time is constant at any point on the workpieces.

According to still another embodiment of present invention, in order to prevent grains and chips from harmfully brought into rubbing parts in a milling chamber or in a sealing box, there is provided an injection device for providing a clean compressed gas of higher pressure than a pressure inside the sealing box the flow into gaps of a main spindle from outside the sealing box, to feed into a dust collector, or out of the milling chamber the grains injected to the workpieces and the chips of the workpieces.

A feature of the present invention is to have a cleaning nozzle in the milling chamber in addition to the powder jet nozzle which is an injection device to inject the grains to the workpieces. The cleaning nozzle is used to inject a high pressure, high speed gas or air to the workpieces. This makes a force exceeding beyond the adhesive force act on the grains so that the grains can be separated from the workpieces. The grains can be removed together with the flow of the injected gas or air. As a result, the shape of the mask of predetermined dimensions covered on the surfaces of the workpieces can be accurately transferred to them. In addition, edges of the concavities can be made sheerly upright.

Another feature of the present invention relates to change of the motion speed of the powder jet nozzle during milling in dependence upon a distance from a center of the main spindle while a plurality of workpieces are revolved on the workpiece holder around the main spindle. This cancels differences of the depths of removal due to radial position difference of the workpieces to the main spindle. This means that the depth of removal can be made uniform.

Still another feature of the present invention relates to workpiece holders which can be planetarily revolved around the main spindle to enable uniform milling on wider areas around the main spindle. This minimizes an effect of distance of any workpiece from the main spindle to the depth of removal. Thus, the depth of removal can be made uniform.

Still another feature of the present invention relates to an arrangement for making the gas or air of higher pressure than the pressure inside the milling chamber to flow into the milling chamber from outside the milling chamber. This is to prevent the grains in the milling chamber from adhering to any of gaps of the rubbing parts and revolving parts thereby preventing the bearings and spindles from being damaged, the grains and chips fluttering in the milling chamber can be blown out not to adhere to the bearings and spindles by the flow of the gas or air.

BRIEF DESCRIPTION OF THE DRAWINGS

In the accompanying drawings:

FIGS. 10A, 10B, 11A, 11B, 12A, 12B, 13A, and 13B are flow charts illustrating examples of control process of a fine grain milling method of the present invention in which FIGS. 10A and 10B are flow charts illustrating two examples with a nozzle speed used as a control parameter, FIG. 11A and 11B are flow charts illustrating two examples with a rotational speed of a work material holder used as a control parameter, FIGS. 12A and 12B are flow charts illustrating two examples with a feed quantity of grains used as a control parameter, and FIGS. 13A and 13B are flow charts illustrating two examples with a flow speed of grains used as a control parameter;

DETAILED DESCRIPTION OF THE PREFERRED EMBODIMENTS

Figure 1:
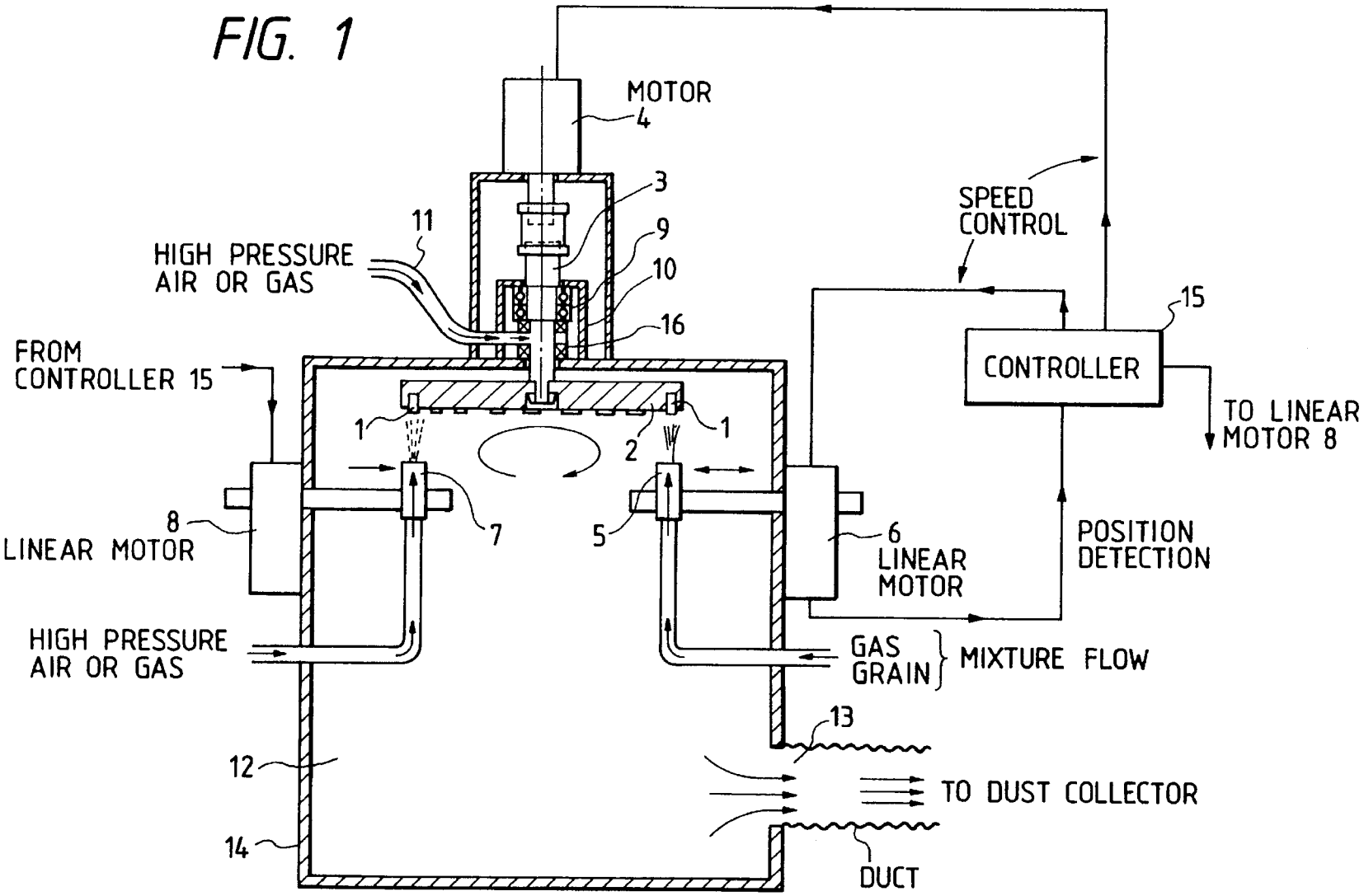
FIG. 1 is a schematic partial cross-sectional view of one embodiment of a fine, grain milling machine according to the present invention.
Figures 2A, 2B, 2C, 2D:
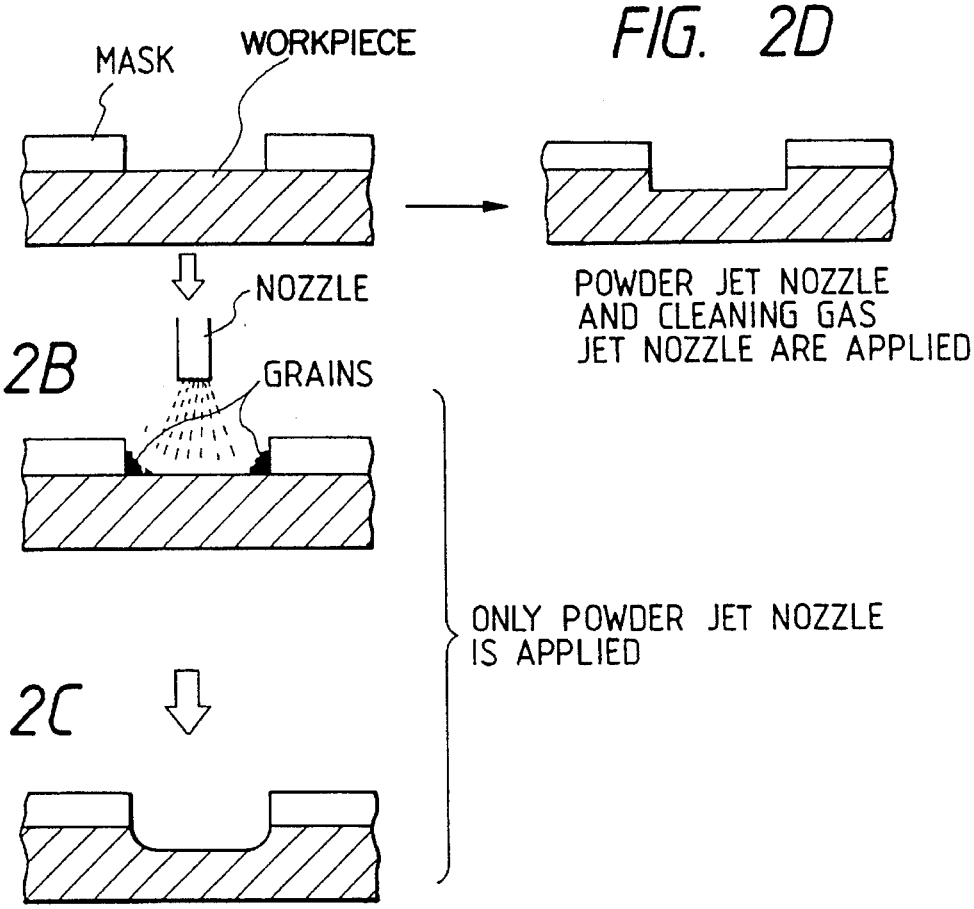
FIGS. 2A, 2B, 2C, and 2D are cross-sections of a workpiece, illustrating fine grain milling processes.
Figure 3A:
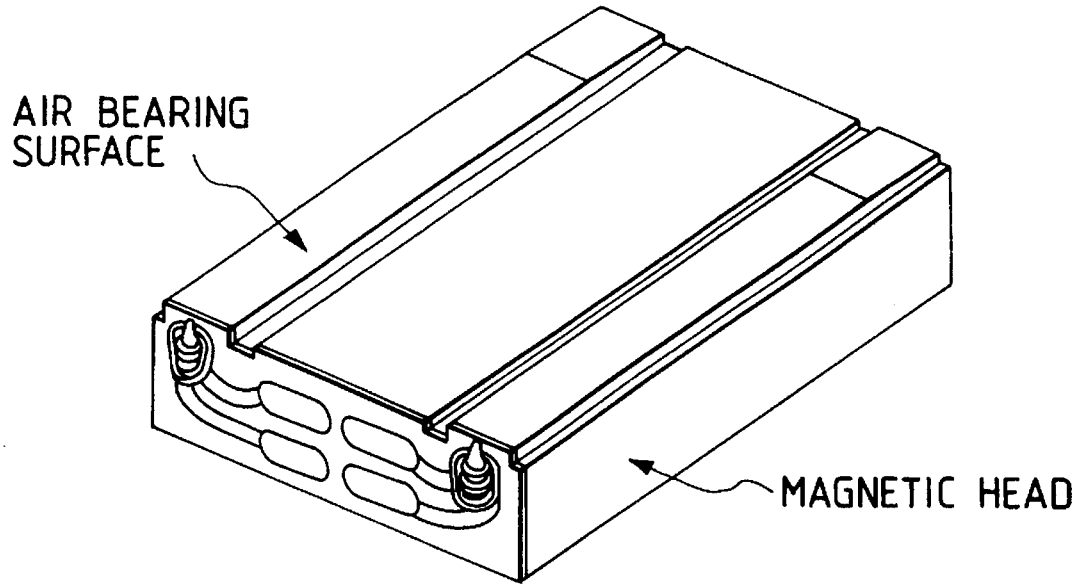
FIGS. 3A and 3B are perspective views of two examples of a thin film magnetic head.
Figure 3B:
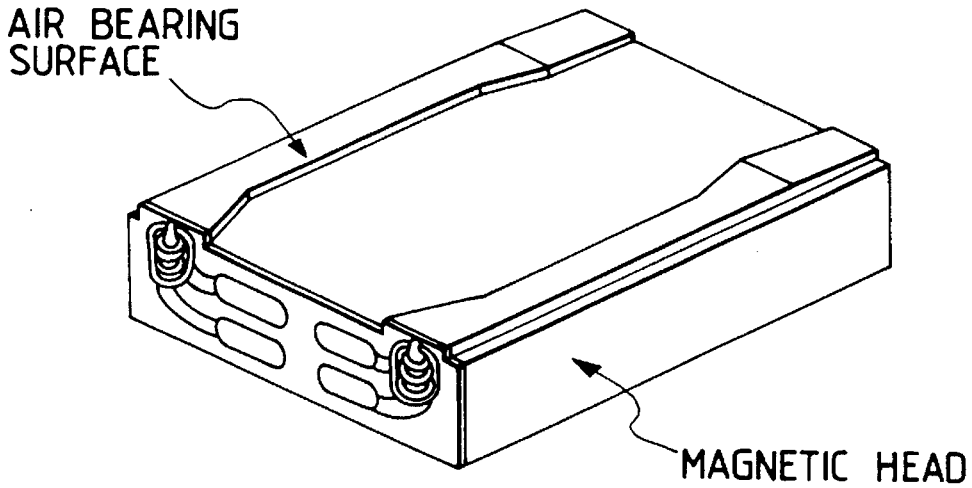

The following describes in detail embodiments according to the present invention by reference to the accompanying drawings. attached on a workpiece holder 2. The workpiece holder 2 is attached to a main spindle 3 so as to enable rotation of the workpiece. The main spindle 3 is attached to a motor 4 through a coupling. A powder jet nozzle 5, adapted to mix grains into a high-pressure fluid, injects the mixture to the work, material 1, with the powder nozzle being attached to a linear motor 6 so as to be movable in parallel to the workpiece 1. A cleaning gas jet nozzle 7, adapted to inject another high-pressure fluid to the workpiece 1 to enable a removal of adhering grains from the workpiece 1, is attached to a linear motor 8. Angles of nozzles 5 and 7 can be adjusted as desired when attached to linear motors 6 and 8, respectively. Distance between the nozzles 5 and 7 and the workpiece holder 2, also, can be adjusted as desired. A position of any of nozzles 5, 7 can be detected from the linear motor to provide a feedback control of a speed of the linear motor or a rotational speed of the workpiece holder 2 through a controller 15 as described in detail later.

The main spindle 3 also is supported on a bearing 9 supported on a bearing holder 10, with the bearing holder 10 having an air hose 11 connected thereto. Air flows into the air hose 11, passes through a gap inside bearing holder 10 into a milling chamber 12 isolated from the outside by a sealing box 14, with the sealing box 14 having a hole 13 in a wall thereof to suction grains into a dust collector.

Figure 7A:
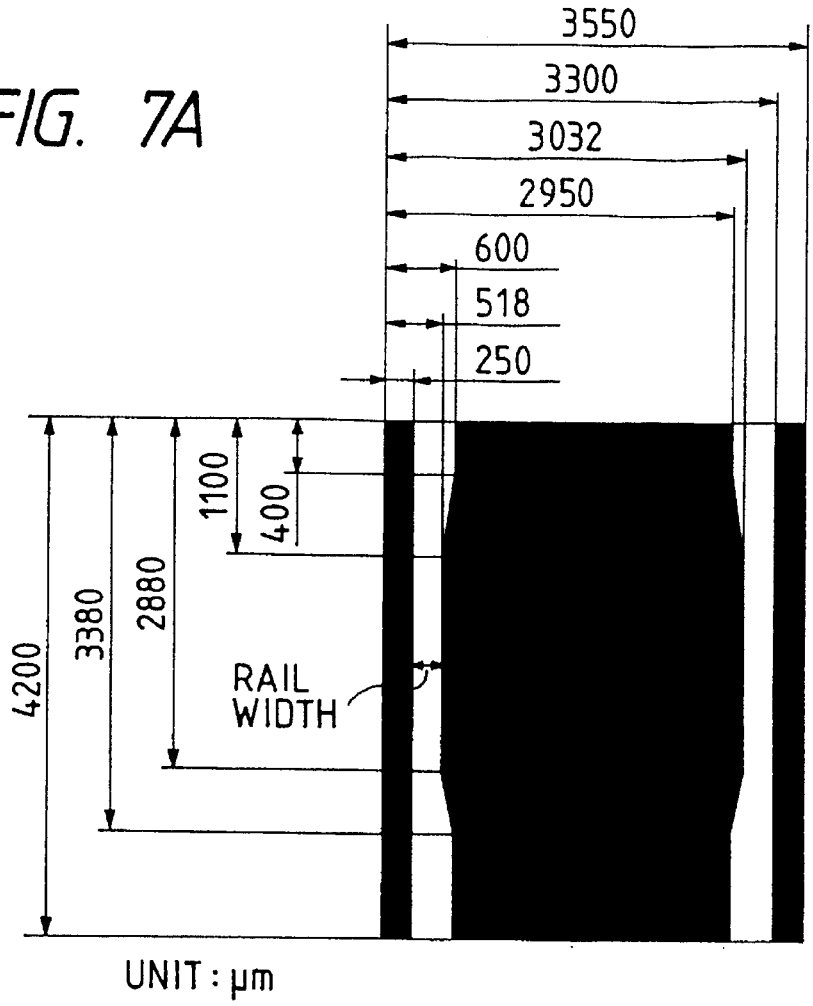
FIGS. 7 and 7B are diagrammatic views of mask dimensions.
Figure 7B:
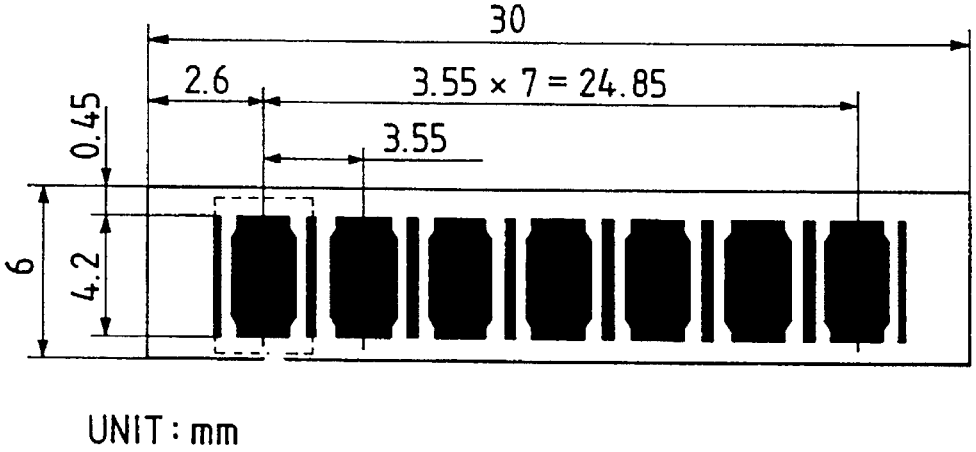

The workpiece holder 2 in this first embodiment is 200 mm in diameter and the workpiece 1 is a substrate made of aluminum oxide ceramic of 40 mm diameter and 4 mm thick having electro-magnetic transducing elements formed therein for use as thin film magnetic heads. The substrate is cut into halves. It is further cut into twenty intervals of 1.1 mm±30 μm. Each of the blocks is mirror-polished at its cut sides. The polished aluminum oxide ceramic block is 4 mm wide, 30 mm long, and 1 mm high. The aluminum oxide ceramic block has a mask made of sus 304 of 10 μm thick adhered thereto with a low-melting-point wax or a polyimide mask adhered thereto. Materials available for the mask include nickel, copper, stainless steel, steel, polyimide epoxy, nylon polyurethane, polyethylene., vinyl chloride, photo-sensitive resist, and similar substances which meet a blasting condition for the work material 1. For the mask made of sus 304, its sticking is positioned at an accuracy of ±10 μm in reference to a magnetic sensor patterned on an air bearing surface side of the workpiece with use of a microscope. For the polyimide mask, ten blocks of workpieces 1 are positioned before being secured on a block aligning jig. The polyimide is laminated on the workpiece 1 as the masking material before being baked at a temperature lower than 130° C. Then, an exposure liquid is coated on it before exposure and development are made to complete patterning. Detailed mask dimensions are shown in FIGS. 7A and 7B.

The twenty blocks of workpieces 1, having the mask adhered thereto as described above are secured on an outermost circumference of workpiece holder 2. The workpiece holder 2 is rotated at a speed of 60 rpm. The powder jet nozzle 5, having a tip hole of 1.5 mm diameter, is reciprocated within a span of 5.5 mm wide from the outermost circumference to the revolving center of work material holder 2. A speed u of powder jet nozzle 5 is determined in accordance with the following equation:

$$u=30/r.$$

where r is a distance from a revolving center of main spindle 3.

Figure 4A:
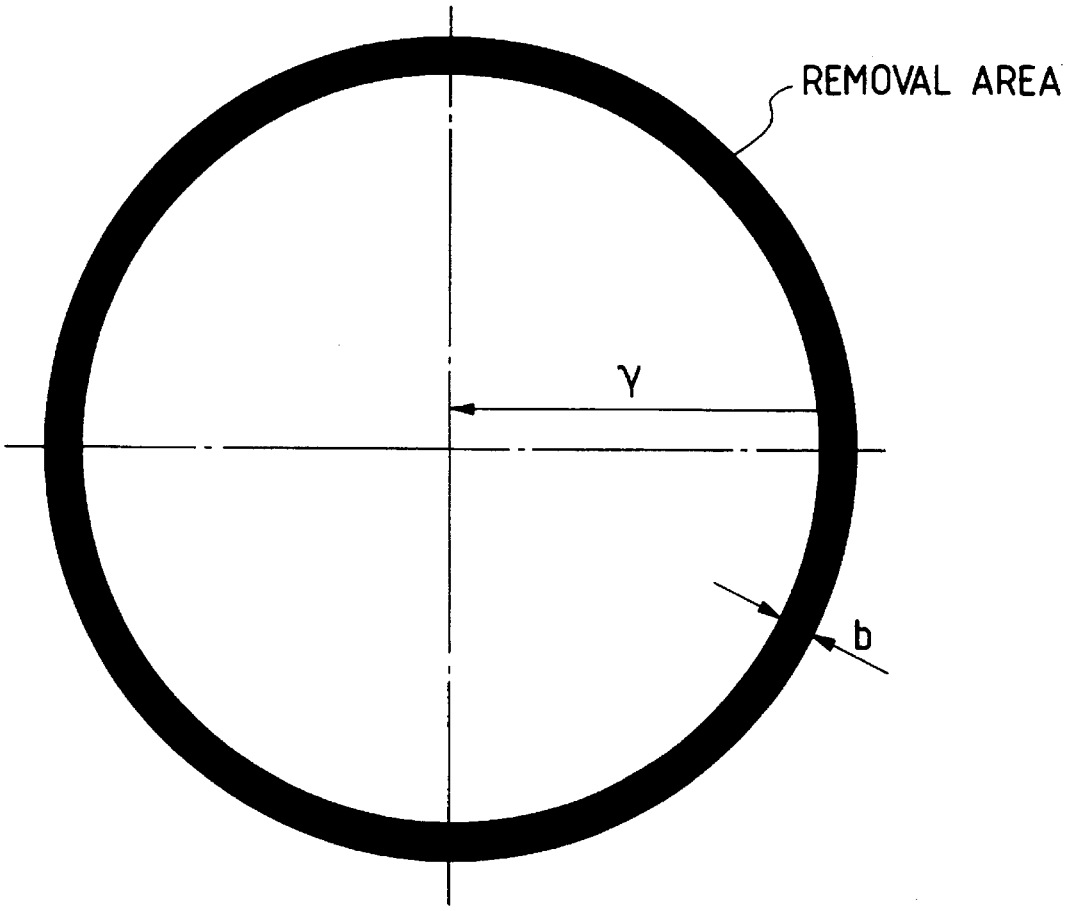
FIG. 4A is a plane view for a region milled by a fine grain milling machine.
Figure 4B:
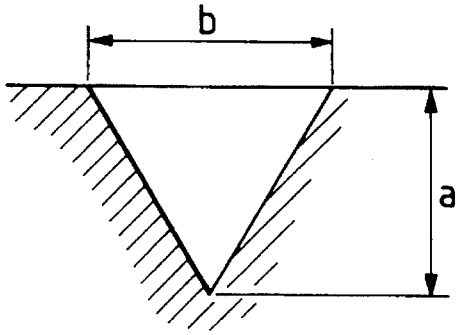
FIG. 4B is a cross sectional view of the region milled on the workpiece corresponding to the region shown in FIG. 4A.

As shown in FIGS. 4A and 4B, the workpiece is milled to sectioned shape with the nozzle being stationary if the workpiece holder 2 is revolved at a speed of N revolutions per second and radius from a revolving center of workpiece holder 2 is r mm. The sectioned shape obtained is an isosceles triangle with height or depth of removal a and base length b. A volume v of removal in $mm^3$/sec is so as to enable rotation of the workpiece $$v=N\pi rab \quad (1)$$

Thus, depth a of removal is $$a=v/(N\pi rb) \quad (2)$$

Figure 5:
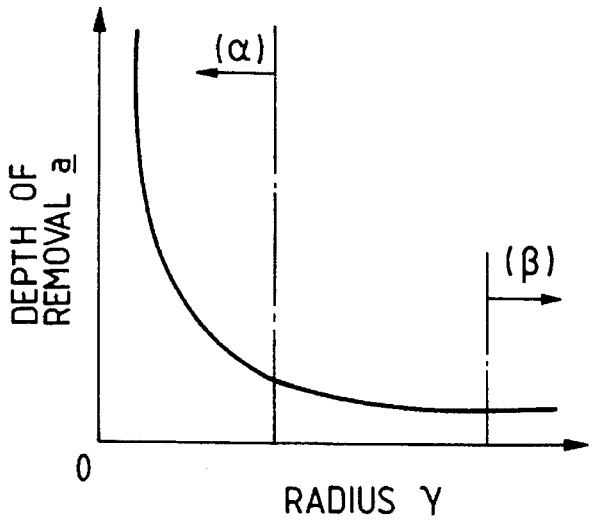
FIG. 5 is a graphical illustration of a relationship between a radius of a milled region and depth of removal.
Figure 6:
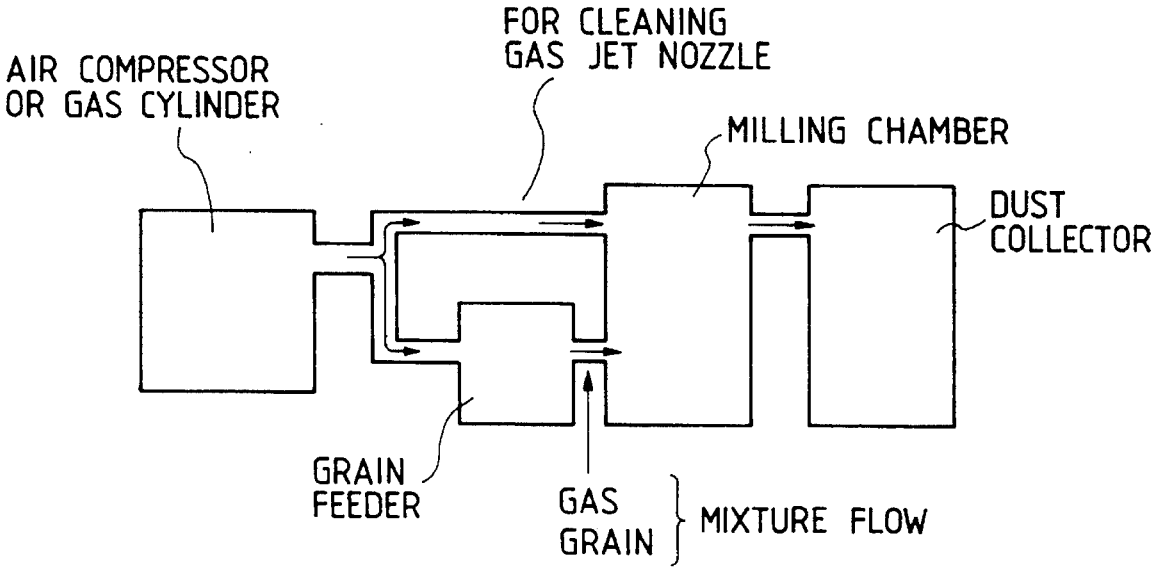
FIG. 6 is a schematic view an example of a fine grain milling machine of the present invention.

The depth of removal a is in inverse proportion to the radius r and as shown in FIG. 5, there are two regions: one is a region α in which the depth of removal a is greatly changed with little deviation of radius r, and the other is a region β in which the depth of removal a is not greatly changed with radius r. Milling depth can be kept maintained in the region β, particularly with little change of radius r. It, however, is not constant in region, particularly in wide area.

The powder jet nozzle 5 injects GC grains of #2000 of 7 μm average diameter at 40 g/min with the grain being mixed with air of 5 kg/$cm^2$. An angle contained between the powder jet nozzle 5 and the workpiece holder 2 is set to 10°, and a distance therebetween is fixed to 20 mm. A grains transport hose is of 5 mm inside diameter and is pressed to 1.5 mm through the nozzle. At the same time as the milling, the cleaning gas jet nozzle 7 also injects air of 5 kg/$cm^2$ so that the grains will not adhere to edges of the mask. The cleaning gas jet nozzle 7 is reciprocated at a speed of 1 mm/sec within the span of 5.5 mm from the outermost circumference to the revolving center of work material holder 2. An angle contained between the cleaning gas jet nozzle 7 and the work material holder 2 is set to 20°, and a distance therebetween is fixed to 10 mm. In addition, air of 5 kg/$cm^2$ flows from the air hose 11 into the milling chamber 12 thorough a gap between the bearing 16 and the main spindle 3 inside bearing holder 10. The gas flowing into the milling chamber 12 has all mist removed to dry. The gases available include air, nitrogen gas, or argon gas.

Figure 8:
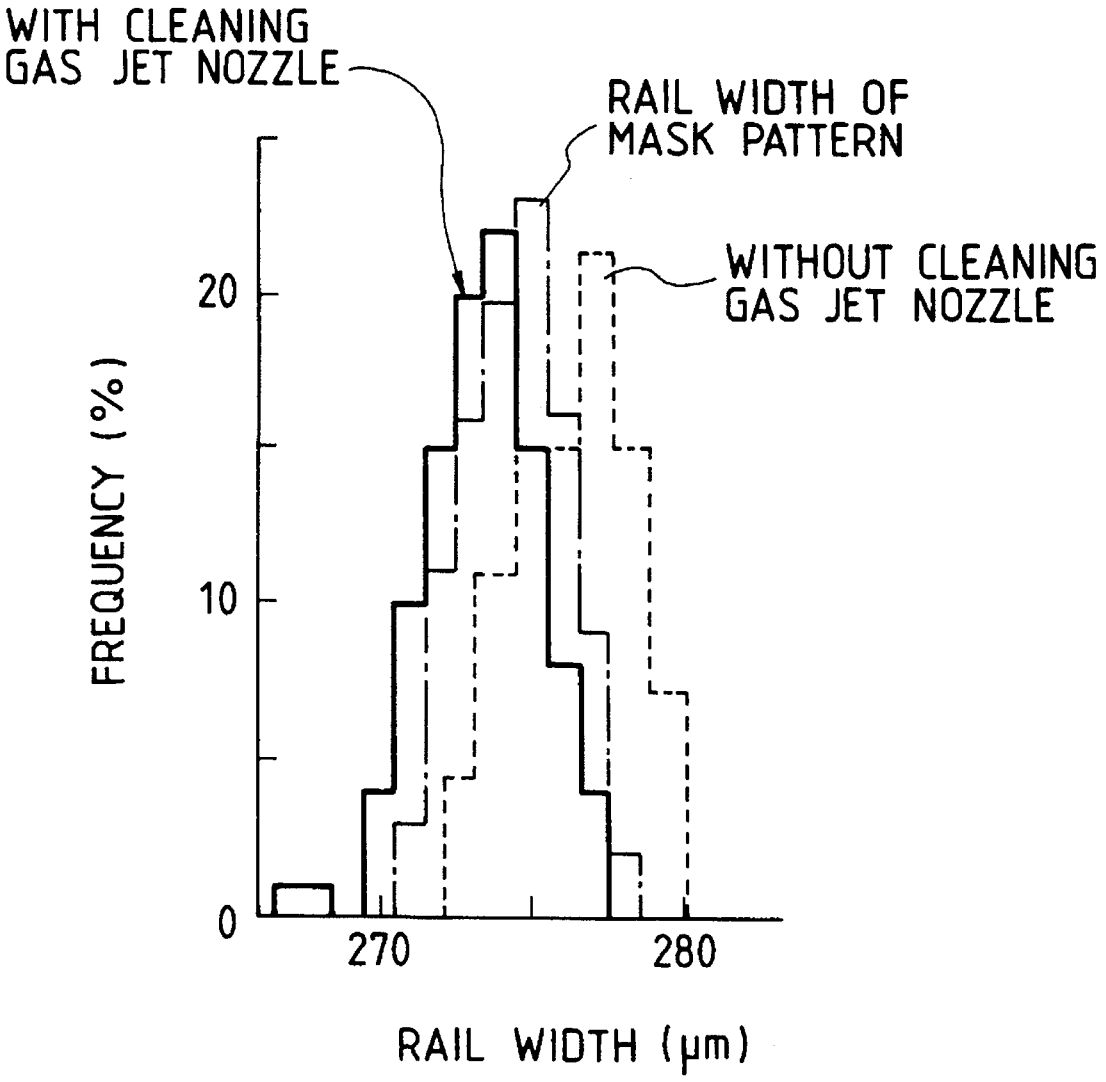
FIG. 8 is a graphical illustration of an example of milling accuracy achievable by the present invention.

As a result of the milling for 10 min in the manner described above, it is possible to accurately transfer the mask pattern and obtain the depth of removal of 10±1 μm. FIG. 8 shows shapes of the blasting with and without use of the cleaning gas jet nozzle after milling, and pattern of the mask before milling. The rail width of the abscissa in FIG. 8 is a dimension of a center portion of the white-out section shown in FIG. 7A, or the mask dimensions on the workpiece. With use of the cleaning gas jet nozzle, as shown in FIG. 8, the mask dimensions can be transferred correctly. Without the nozzle, on the other hand, the rail width is wider as the mask has grains accumulated in corners thereof.

As described above, the mask shape is transferred to the workpiece. Then, each of the blocks is cut to magnetic head dimensions to obtain the magnetic head.

Now, the following describes a control system which can control the speeds of the linear motor 6 and linear motor 8 and the rotational speed of the work material holder 2.

Figure 9:
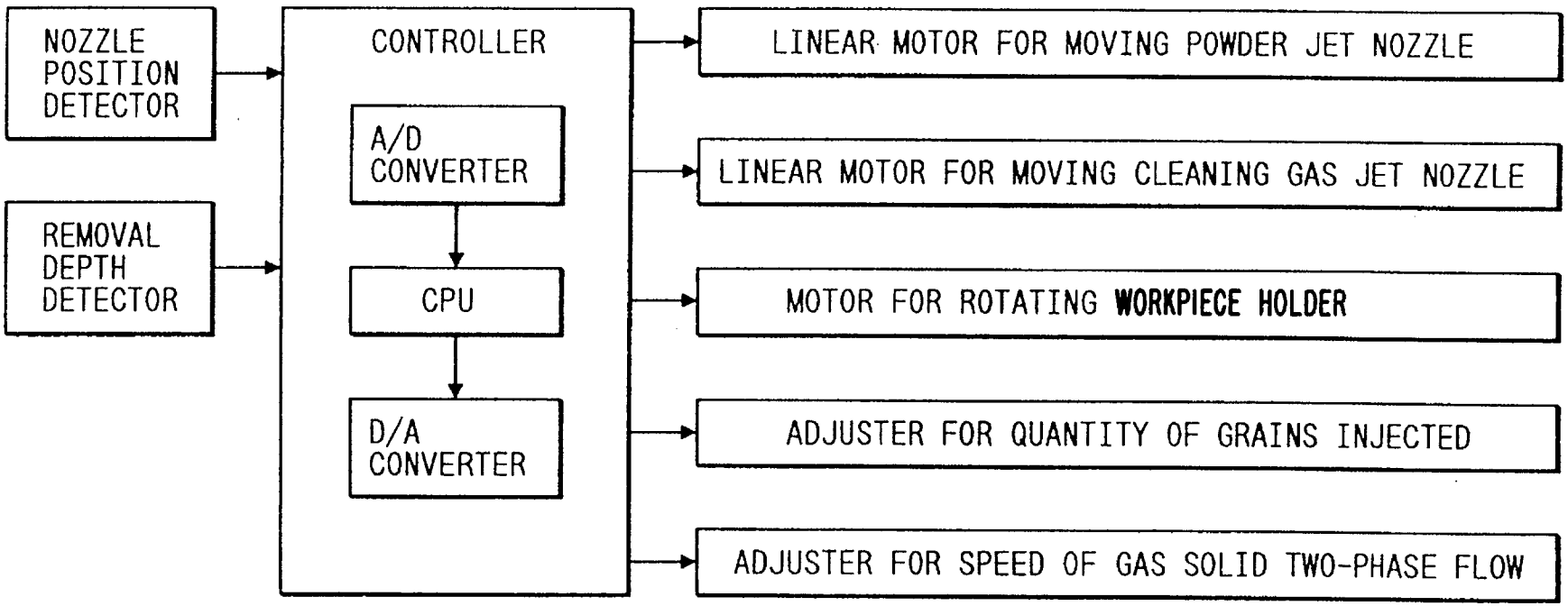
FIG. 9 is a schematic view of an example of a control system for a fine grain milling machine of the present invention.
Figure 14:
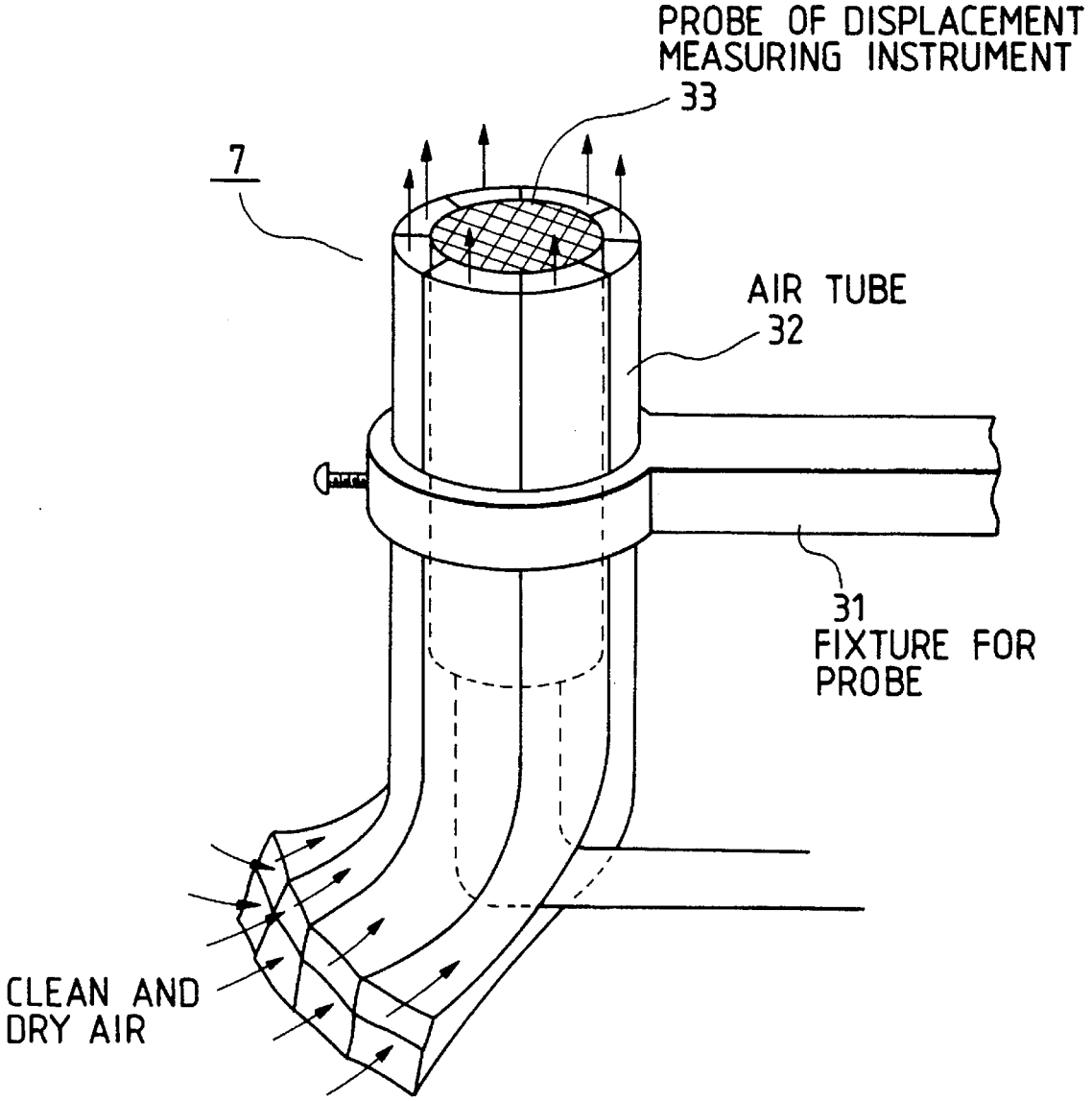
FIG. 14 is a perspective view of a probe of an optical fiber type non-contact displacement measuring instrument of the present invention.

In order to enable a uniform contact area of grains on unit area of the workpiece, in accordance with the control system of the present invention, as shown in FIG. 9, a control system is proposed which includes an analog input data of the position of powder jet nozzle 5 measured from the revolving center of workpiece holder 2 and the depth of removal of the workpiece detected at the same time as the milling. An A/D converter of a controller in the control system converts the analog input signals to digital signals. A CPU of the controller computes and feeds out the digital signals. A D/A converter of the controller reconnects the output digital signals to analog signals. The output analog signals control the speed of linear motor 6 for moving the powder jet nozzle 5, the speed of the linear motor 8 for moving the cleaning gas jet nozzle 7, the speed of motor 4 for revolving the workpiece holder 2, the quantity of the grains injected, and the speed of gas solid two-phase flow. A linear encoder is provided for the linear motor 6 for moving the powder jet nozzle 5 and the linear motor 8 for moving the cleaning gas jet nozzle 7 each to detect distance from the revolving center of workpiece holder 2. In order to detect that a desired depth of removal has been obtained during milling, as shown in FIG. 14, an optical fiber type non-contact displacement measuring instrument is attached to linear motor 8 for moving cleaning gas jet nozzle 7. The measuring instrument has a probe 33 of 1 mm diameter and can measure displacement at an accuracy of ±0.1 μm. In detection of the depth of removal, the grains scattered in milling chamber 12 cause a measuring error. An air tube 32 blasts clean, dry air at 5 kg/$cm^2$ toward the workpiece from around the probe 33 to prevent the grains from entering a measuring area of the probe 33 and also serves as the cleaning gas jet nozzle 7.

Figure 10A:
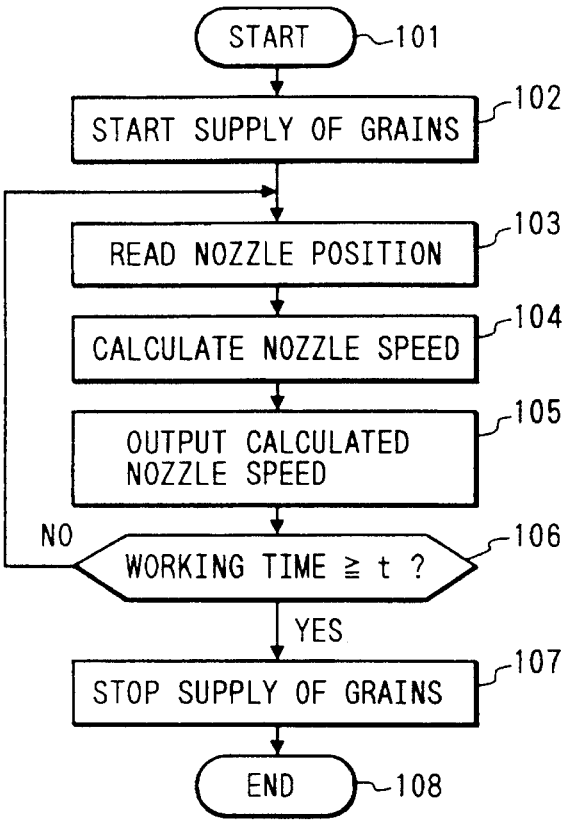
Figure 10B:
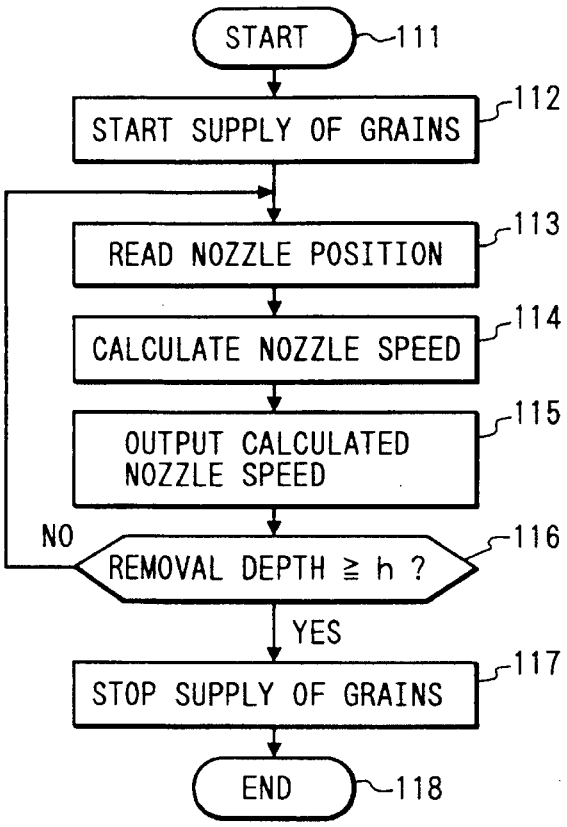
Figure 11A:
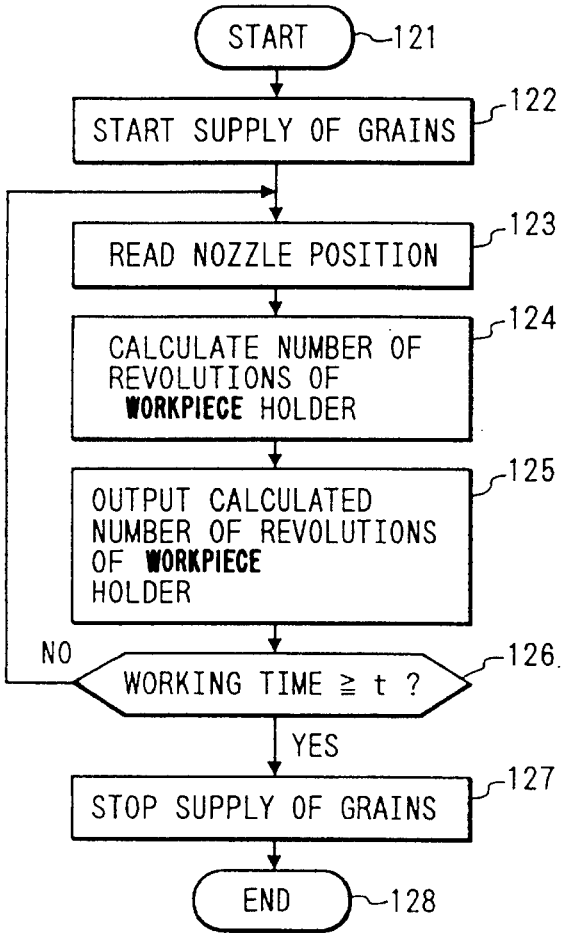
Figure 11B:
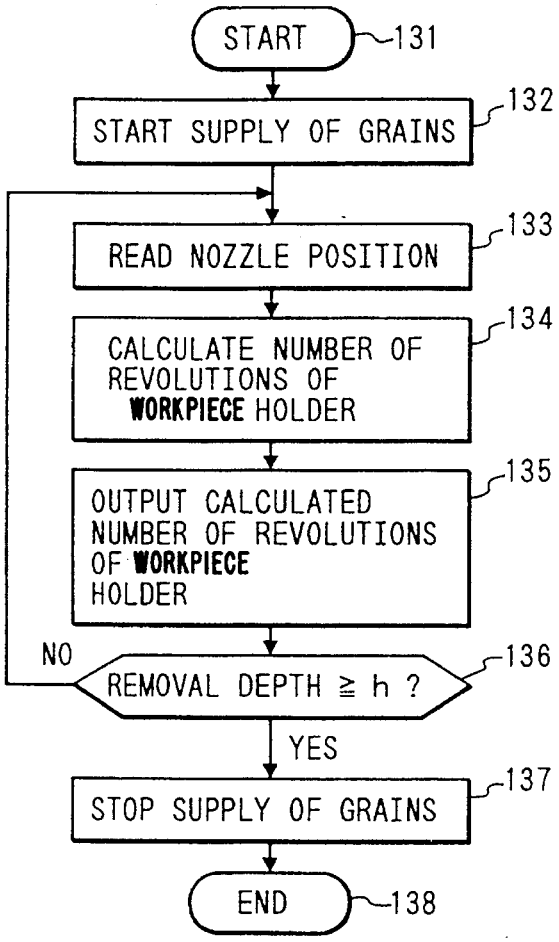
Figure 12A:
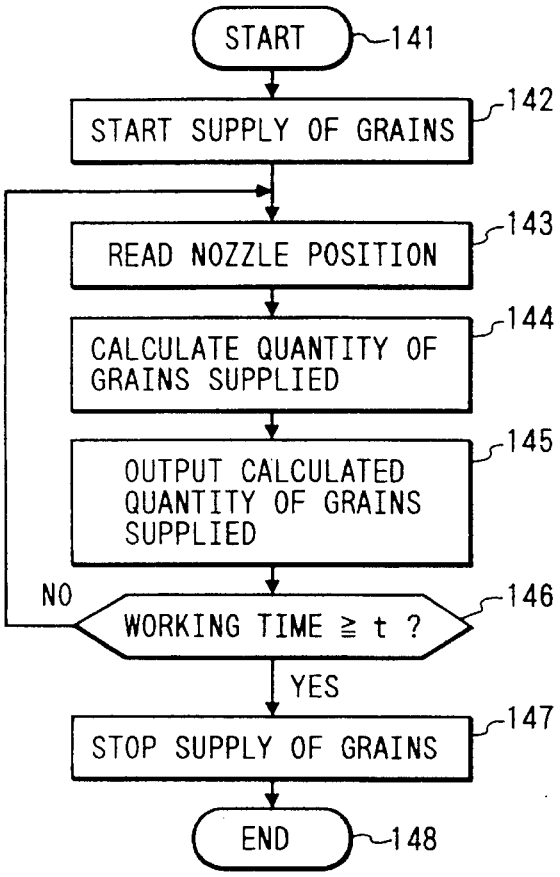
Figure 12B:
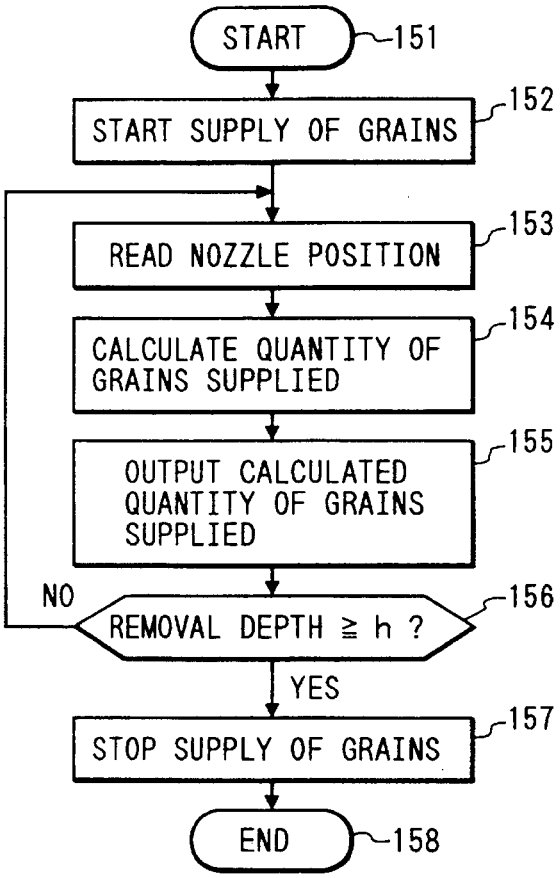
Figure 13A:
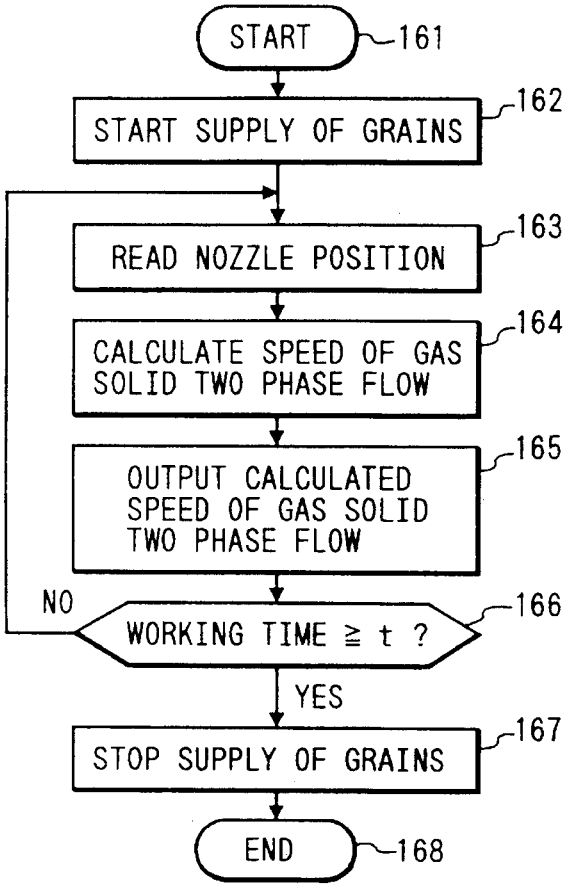
Figure 13B:
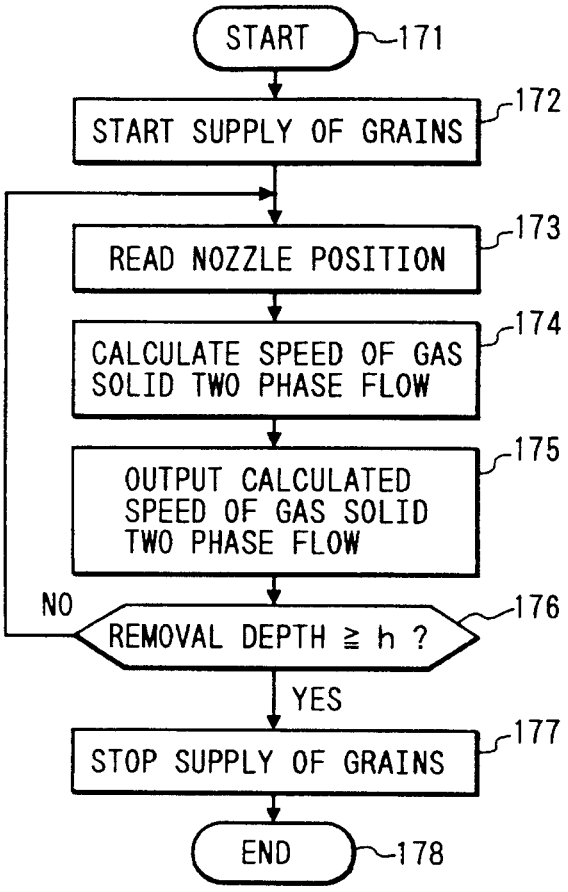

In the embodiment of FIGS. 10A and 10B, there are eight control patterns. A first is to control the nozzle speed depending on the nozzle position distant from the revolving center of main spindle 3, as the milling time is used as a judgement reference for the end of sequence (FIG. 10A). A second pattern is to control the same nozzle speed as the depth of removal is used as a judgement reference for the end of sequence (FIG. 10B). Third and fourths patterns are to control the rotation speed of workpiece holder 2, as the milling time and the depth of removal are used as judgement 10 references for the ends of sequence, respectively (FIGS. 11A and 11B). Fifth and sixth patterns are to control the feed quantity of the grains with the nozzle position, as the milling time and the depth of removal are used as judgement references for the ends of sequence, respectively (FIGS. 12A and 12B). Seventh and eighth patterns are to control the flow speed of the grains with the nozzle position, as the milling time and the depth of removal are used as judgement references for the ends of sequence, respectively (FIGS. 13A and 13B).

A basic control flow of the control system is described below by reference to FIG. 10A. If the sequence starts (step 101), a predetermined amount of grains is supplied (step 102). In turn, position of the powder jet nozzle is read (step 103). The nozzle speed which is a control parameter is calculated (step 104) and fed out (step 105). Then, the milling time is measured before being judged whether or not it exceeds beyond a predetermined time t (step 106). If the milling time does not exceed the time t, the nozzle position is read again to repeat the sequence; if it exceeds beyond the time t, supplying the grains is stopped to end the sequence (step 107). The milling time in this embodiment is set to 30 min. Note that as shown in FIG. 10B, it is possible to use the nozzle speed as the control parameter (step 115), while use the depth of removal as the judgement reference for the end of sequence (step 116). Further, as shown in FIGS. 11A and 11B, it is possible to use the rotational speed of workpiece holder 2 as the control parameter.

Relationships between parameters and a current and voltage values should be kept known. In this embodiment, the quantity of grains injected is changed by amplitude of vibration as the grain feeder supply the grains by vibration. The speed of gas solid two-phase flow is changed with the supply pressure of grains.

As a result of the milling for 10 min described above, it is possible to accurately transfer the mask pattern and obtain the depth of removal of 10±1 μm with little cleaning operations. Then, by virtue of the features of the present invention described above, it is possible to cut the block to magnetic head dimension and successfully fabricate a thin film magnetic head of a highly accurate shape.

Figure 15:
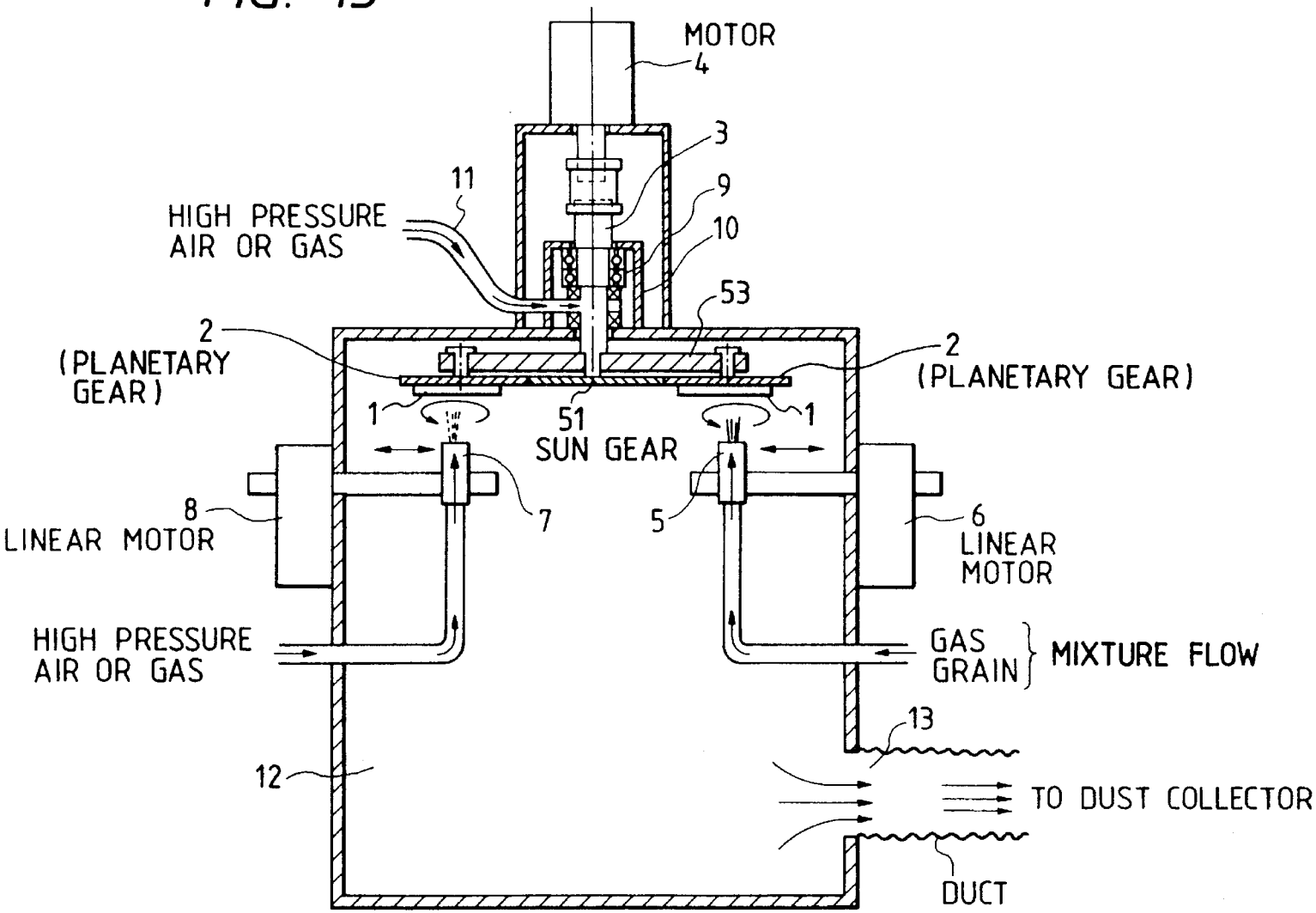
FIG. 15 is a schematic partial cross-sectional view of another embodiment of a fine grain milling machine according to the present invention.
Figure 16:
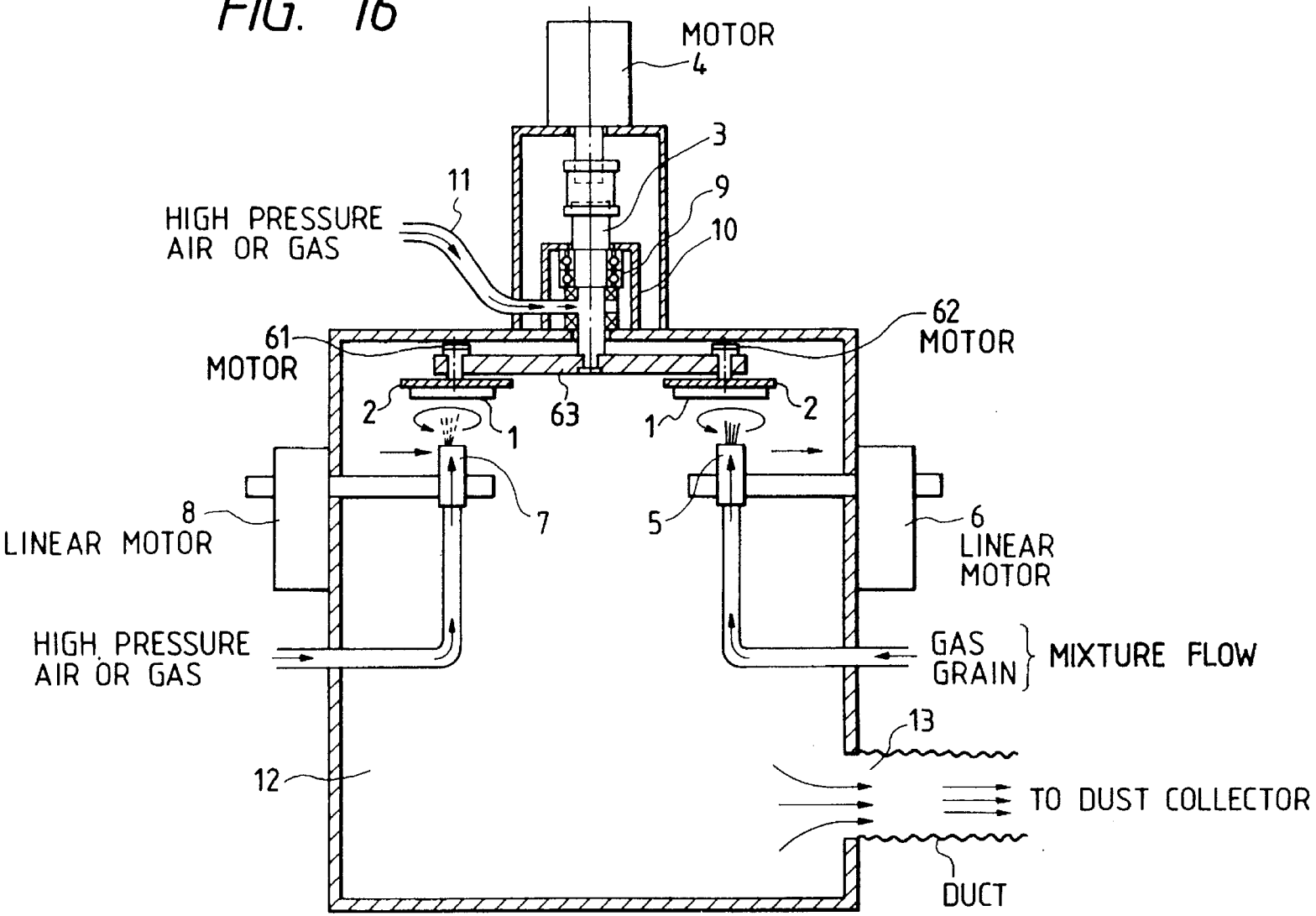
FIG. 16 is a schematic partial cross-sectional view of still another embodiment of a fine grain milling machine according to the present invention.

In the embodiment of FIG. 15, the workpiece holders 2 are planetarily move by a gear arrangement. In FIG. 16 each of the workpiece holders 2 is planetarily moved and driven by the respective motors 61 and 62. A center of each workpiece holder 2 is 154.6 mm radially distant from that of a main spindle 3. In FIG. 15, the planetary gear is of 1.09.1 mm circle diameter of contact, while a sun gear 51 is of 100 mm. In FIG. 16, each workpiece holder 2 is of 100 mm diameter.

In FIG. 15, the planetary gear, formed as workpiece holder 2, has gear teeth provided on its circumference. The sun gear 51 does not rotate and is held to a wall of milling chamber 12 by a fixing member (not shown). Each of the workpiece holders 2 is rotatably held on a supporting table 53, with the table 53 being held to the main spindle 3. The table 53, therefore, can be driven by main spindle 3 to rotate around it.

In FIG. 16, the motors 61 and 62 are attached to a supporting table 63. Each of the workpiece holders 2 is coupled to the motor 61 or 62 and is rotatably supported on the supporting table 63. The workpiece holder 2, therefore, is driven by motor 61 or 62 to rotate around the motor shaft. The table 63 is maintained to the main spindle 3. The table 63, therefore, can be driven by main spindle 3 to rotate therewith.

In the embodiments shown n FIGS. 15 and 16, each of workpiece holders 2 is rotated at 55 rpm, while main spindle 3 is rotated 60 rpm. As in the first embodiment shown in FIG. 1, the alumina oxide ceramic substrate is cut to blocks, which are adhered with the masking material. The workpiece material holder 2 has twenty blocks arranged and adhered thereon by wax. Each of the nozzles 5, 7 is reciprocated at a speed of 0.3 mm/sec within a span of 80 mm from the outermost circumference of workpiece holder 2 to the center thereof. Then, the GC grains of #2000 are injected under the same conditions as in the first embodiment in FIG. 1. The cleaning gas jet nozzle 7 also is used. As a result, we can obtain the depth of removal to 10±0.5 μm in a period of 40 min for fabrication of a high-performance magnetic head.

Accordingly, the present invention is capable of accurately transferring the mask dimensions to the work material as the grains adhered to the corners of the mask can be removed as the cleaning gas jet nozzle blasts the gas to the work material at the same time as milling. Also, the present invention can accomplish the shape of sheer vertical edges in the blasted concaves. This allows the magnetic head to be stably carried around 1 μm above the magnetic disk for high-density recording and reading.

Further, the present invention can uniformly mill all the workpieces attached to the work material holder, as the workpieces are revolved, and the nozzles are reciprocated in parallel with the workpieces.

Furthermore, the present invention provides the advantage that it prevents the grains and chips from sticking to the rubbing parts in the milling chamber. This is because the clean gas of higher pressure than the one in the milling chamber flows into the gaps of the bearings and similar parts. The rubbing parts are free of any damage as they will not bring in any of the grains and chips. This does not cause any of the rubbing parts to deteriorate the characteristic performance of the rubbing parts, which result in long service life.

In short, the fine grain milling method and machine according to the present invention allows milling the air bearing surface of the thin film magnetic head at a high accuracy and efficiency.

What is claimed is:

1. An apparatus for fine grain milling wherein a workpiece is processed to a desired shape by powder mixed in a high-pressure fluid injected at the workpiece covered with a desired mask or pattern, said apparatus comprising:

a workpiece holder for mounting a workpiece, said workpiece holder being rotatable around a main spindle;

injecting means having a nozzle for injecting the powder mixed in the high-pressure fluid at a surface of the workpiece so that the surface of the workpiece is processed to a desired shape;

removing means for removing powder adhered to the processed surface of the workpiece by injecting a high-pressure fluid to the powder adhered to the processed surface of the workpiece;

sealing means for sealing said workpiece holder and said injecting means;

dust collecting means for collecting powder and chips out of said sealing means; and control means for controlling relative motion of said workpiece holder and said nozzle so that the quantity and speed of flow of the powder contacting a unit area of the processed surface of the workpiece in a unit time are made uniform on the processed surface of the workpiece, wherein:

said workpiece holder, having the workpiece mounted thereon, is rotated with said main spindle, said nozzle for injecting the powder mixed in the high-pressure fluid is reciprocated in a radial direction to and from the center of said main spindle, a nozzle end is maintained at a predetermined distance from the workpiece mounted on said workpiece holder, and said control means controls the moving speed of said nozzle in dependence upon the distance from the center of said main spindle to the position of said nozzle.

2. An apparatus for fine grain milling wherein a workpiece is processed to a desired shape by powder mixed in a high-pressure fluid and injected at the workpiece covered with a desired mask or pattern, said apparatus comprising:

a workpiece holder for mounting a workpiece, said workpiece holder being rotatable around a main spindle;

injecting means having a nozzle for injecting the powder mixed in the high-pressure fluid at a surface of the workpiece so that the surface of the workpiece is processed to a desired shape;

removing means for removing powder adhered to the processed surface of the workpiece by injecting a high-pressure fluid to the powder adhered to the processed surface of the workpiece;

sealing means for sealing said workpiece holder and said injecting means;

dust collecting means for collecting powder and chips out of said sealing means; and control means for controlling relative motion of said workpiece holder and said nozzle so that the quantity and speed of flow of the powder contacting a unit area of the processed surface of the workpiece in a unit time are made uniform on the processed surface of the workpiece, wherein:

said workpiece holder, having the workpiece mounted thereon, is rotated with said main spindle, said nozzle for injecting the powder mixed in the high-pressure fluid is reciprocated in a radial direction to and from the center of said main spindle, a nozzle end is maintained at a predetermined distance from the workpiece mounted on said workpiece holder, and said control means controls the feeding quantity of the powder in dependence upon the distance from the center of said main spindle to the position of said nozzle end.

3. An apparatus for fine grain milling wherein a workpiece is processed to a desired shape by powder mixed in a high-pressure fluid and injected at the workpiece covered with a desired mask or pattern, said apparatus comprising:

a workpiece holder for mounting a workpiece, said workpiece holder being rotatable around a main spindle;

injecting means having a nozzle for injecting the powder mixed in the high-pressure fluid at a surface of the workpiece so that the surface of the workpiece is processed to a desired shape;

removing means for removing powder adhered to the processed surface of the workpiece by injecting a high-pressure fluid to the powder adhered to the processed surface of the workpiece;

sealing means for sealing said workpiece holder and said injecting means;

dust collecting means for collecting powder and chips out of said sealing means; and control means for controlling relative motion of said workpiece holder and said nozzle so that the quantity and speed of flow of the powder contacting a unit area of the processed surface of the workpiece in a unit time are made uniform on the processed surface of the workpiece, wherein:

said workpiece holder, having said workpiece mounted thereon, is rotated with said main spindle, said nozzle for injecting the powder mixed in the high-pressure fluid is reciprocated in a radial direction to and from the center of said main spindle, a nozzle end is maintained at a predetermined distance from the workpiece mounted on said workpiece holder, and said control means controls the flow speed of the powder in dependence upon the distance from the center of said main spindle to the position of said nozzle end.

4. An apparatus for fine grain milling in which a workpiece is covered with a mask having therethrough a hole pattern for a desired shape and is processed to the desired shape by powder mixed with a fluid and injected to the workpiece through the mask, said apparatus comprising;

a workpiece holder for mounting a workpiece, said workpiece holder being rotatable around an axis parallel to a main spindle;

a support table for supporting said workpiece holder, said support table being rotatable around the main spindle;

first injecting means, having a first nozzle, for injecting the powder mixed with the fluid through the mask and at a surface of the workpiece to process the surface of the workpiece to the desired shape;

second injecting means having a second nozzle, for injecting a high-pressure fluid to remove powder adhered to edges of the hole pattern and on the processed surface of the workpiece as the processed surface is processed by the powder mixed with fluid, so as to process the processed surface of the workpiece with a desired precision;

sealing means for sealing said workpiece holder and said first injecting means;

dust collecting means for collecting powder and chips out of said sealing means; and control means for controlling relative motion of said workpiece holder and said first nozzle in dependence upon the quantity and speed of flow of the powder mixed with fluid contacting a unit area of the processed surface of the workpieces in a unit time;

wherein said control means controls the moving speed of said first nozzle in dependence upon the position of said first nozzle.

5. An apparatus for fine grain milling in which a workpiece is covered with a mask having therethrough a hole pattern for a desired shape and is processed to the desired shape by powder mixed with a fluid and injected to the workpiece through the mask, said apparatus comprising;

a workpiece holder for mounting a workpiece, said workpiece holder being rotatable around an axis parallel to a main spindle;

a support table or supporting said workpiece holder, said support table being rotatable around the main spindle;

first injecting means, having a first nozzle, for injecting the powder mixed with the fluid through the mask and at a surface of the workplace to process the surface of the workpiece to the desired shape;

second injecting means having a second nozzle, for injecting a high-pressure fluid to remove powder adhered to edges of the hole pattern and on the processed surface of the workpiece as the processed surface is processed by the powder mixed with fluid, so as to process the processed surface of the workpiece with a desired precision;

sealing means for sealing said workpiece holder and said first injecting means;

dust collecting means for collecting powder and chips out of said sealing means; and control means for controlling relative motion of said workpiece holder and said first nozzle in dependence upon the quantity and flow of the powder mixed with fluid contacting a unit area of the processed surface of the workpiece in a unit time;

wherein said control means controls the feeding quantity of the powder mixed with fluid in dependence upon the position of said first nozzle.

6. An apparatus for fine grain milling in which a workpiece is covered with a mask having therethrough a hole pattern for a desired shape and is processed to the desired shape by powder mixed with a fluid and injected to the workpiece through the mask, said apparatus comprising:

a workpiece holder for mounting a workpiece, said workpiece holder being rotatable around an axis parallel to a main spindle;

a support table for supporting said workpiece holder, said support table being rotatable around the main spindle;

first injecting means, having a first nozzle, for injecting the powder mixed with the fluid through the mask and at a surface of the workpiece to process the surface of the workpiece to the desired shape;

second injecting means having a second nozzle, for injecting a high-pressure fluid to remove powder adhered to edges of the hole pattern and on the processed surface of the workpiece as the processed surface is processed by the powder mixed with fluid, so as to process the processed surface of the workpiece with a desired precision;

sealing means for sealing said workpiece holder and said first injecting means;

dust collecting means for collecting powder and chips out of said sealing means; and control means for controlling relative motion of said workpiece holder and said first nozzle in dependence upon the quantity and flow of the powder mixed with fluid contacting a unit area of the processed surface of the workpiece in a unit time;

wherein said control means controls the flow speed of the powder mixed with fluid in dependence upon the distance from the center of said main spindle to the position of said first nozzle.

* * * * *